United States Patent [19]

Fitoussi et al.

[11] 4,339,416

[45] Jul. 13, 1982

[54] URANIUM RECOVERY PROCESS

[75] Inventors: Richard Fitoussi, Versailles; Claude Musikas, Villebon, both of France

[73] Assignee: Commissariat a l'Energie Atomique, Paris, France

[21] Appl. No.: 94,889

[22] Filed: Nov. 16, 1979

[30] Foreign Application Priority Data

Nov. 28, 1978 [FR] France ..... 78 33544

[51] Int. Cl.[3] ..... C01G 43/00

[52] U.S. Cl. ..... 423/10; 423/8

[58] Field of Search ..... 423/8, 10

[56] References Cited

U.S. PATENT DOCUMENTS

| | | | |
|---|---|---|---|
| 2,858,187 | 10/1958 | Fitch et al. | 423/8 |
| 3,146,064 | 8/1964 | Moore | 423/10 |
| 3,243,257 | 3/1966 | Coleman | 423/10 |
| 4,012,480 | 3/1977 | Delvalle | 423/8 |
| 4,243,637 | 1/1981 | Bradford et al. | 423/10 |

*Primary Examiner*—Edward A. Miller

[57] ABSTRACT

Process for the recovery of the uranium present in a phosphoric acid solution by bringing the said solution into contact with an organic solvent suitable for extracting the uranium, wherein the said organic solvent comprises a system of extractants constituted by an acid organophosphorus compound having at least one sulphur atom and by a neutral phosphine oxide of formula:

in which $R_1$, $R_2$ and $R_3$ are identical or different alkyl, alkoxyalkyl or aryl radicals.

10 Claims, 4 Drawing Figures

URANIUM RECOVERY PROCESS

BACKGROUND OF THE INVENTION

The present invention relates to a process for the recovery of the uranium present in phosphoric acid solutions and particularly in phosphoric acid solutions obtained from phosphatic ores.

It is known that phosphatic ores contain by no means negligible uranium quantities which, during the action of a sulphuric solution on these ores, pass into the phosphoric acid solution obtained.

The presently known processes for ensuring the recovery of the uranium present in phosphoric acid obtained from phosphatic ores generally involve an extraction by means of suitable organic solvents. However, the hitherto used solvents have proved to be relatively ineffective due to the large quantities of phosphoric acid solution to be treated, the high phosphoric acid concentration thereof and the simultaneous presence of iron in the solutions.

BRIEF SUMMARY OF THE INVENTION

The present invention relates to a process for the recovery of the uranium present in a phosphoric acid solution by means of organic solvents, making it possible to obtain good extraction levels and a satisfactory separation of the iron, even when the phosphoric acid concentration of the solution is relatively high, for example of the order of 8 M.

The invention therefore relates to a process for the recovery of the uranium present in a phosphoric acid solution by bringing the said solution into contact with an organic solvent suitable for extracting the uranium, wherein the said organic solvent comprises a system of extractants constituted by an acid organophosphorus compound having at least one sulphur atom and by a neutral phosphine oxide of formula:

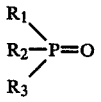

in which $R_1$, $R_2$ and $R_3$ are identical or different alkyl, alkoxyalkyl or aryl radicals.

According to a feature of the process of the invention the acid organophosphorus compound having at least one sulphur atom is a dialkyl-dithiophosphoric acid such as di-2-ethylhexyl-dithiophosphoric acid, dibutyl-dithiophosphoric acid and bis-(2,6-dimethyl-4-heptyl)-dithiophosphoric acid. Preferably di-2-ethylhexyldithiophosphoric acid (DEHDTP) is used.

According to the invention the neutral phosphine oxide used in accordance with the above formula is advantageously chosen from among the phosphine oxides in which $R_1$, $R_2$ and $R_3$ are identical or different alkyl radicals having 4 to 12 carbon atoms, or from among phosphine oxides in which at least one of the radicals $R_1$, $R_2$ or $R_3$ is an alkoxyalkyl radical with 4 to 12 carbon atoms, preferably with one alkoxymethyl radical, the other radicals being $C_4$ to $C_{12}$ alkyl radicals.

As an example of the phosphine oxide which can be used reference is made to trioctyl phosphine oxide (TOPO) and di-n-hexyl-octyloxymethyl phosphine oxide (POX 11).

The process as defined hereinbefore utilises in an advantageous manner the nature of the organic solvent used. Thus, the use of a system of extractants constituted by said acid organophosphorus compound and by said neutral phosphine oxide makes it possible to obtain high uranium (VI) extraction coefficients and also ensure a separation of the iron and the uranium when the contacting time between the phosphoric acid solution and the organic solvent is limited to appropriate values or when a branches chain dialkyl dithiophosphoric acid is used, such as bis-(2,6-dimethyl-4-heptyl)-dithiophosphoric acid.

Moreover, the use of such a system of extractants makes it possible to obtain a satisfactory extraction of uranium (VI), even when the phosphoric acid concentration is high. It is then possible to reextract the uranium present in the organic solvent by conventional means, such as concentrated phosphoric acid, reducing solution, alkaline solution, etc.

For the performance of the process according to the invention the above system of extractants is advantageously diluted in an inert solvent, such as dodecane. The total concentration of extractants is preferably in excess of 0.6 M in order to obtain good uranium extraction levels.

In the organic solvent the concentration of each of the extractants of the above system is advantageously such that the molar ratio of the neutral phosphine oxide to the acid organophosphorus compound having at least one sulphur atom is between 1/9 and 3/1 and preferably close to 1.

Thus, according to the process of the invention during the extraction of the uranium in a phosphoric medium and by means of such a system of extractants a complex is formed having one neutral phosphine oxide molecule and one acid organophosphorus compound molecule, which makes it possible to ensure uranium extraction under good conditions, because such a complex is neutral and the steric volume requirement in the equatorial plane of the $UO_2^{2+}$ ion enables it to be assumed that a complex is obtained with all its coordination sites occupied.

Thus, the best results are obtained when the organic solvent comprises an equimolar mixture of an acid organophosphorus compound having at least one atom of sulphur and a neutral phosphine oxide.

According to the invention the uranium extracted in the organic solvent is then recovered by bringing the organic solvent into contact either with an aqueous phosphoric acid solution having a phosphoric acid concentration in excess of 10 M, or with an aqueous phosphoric acid solution containing a reducing agent for reducing uranium (VI) to uranium (IV).

It is pointed out that the process according to the invention can be performed in any conventional extraction apparatus, such as mixer-settler sets, pulsed columns, centrifugal extractors, etc.

BRIEF DESCRIPTION OF THE DRAWINGS

The invention is explained in greater detail hereinafter relative to non-limitative embodiments and with reference to the drawings, wherein show.

DETAILED DESCRIPTION OF EXEMPLIFIED EMBODIMENTS OF THE INVENTION

Example 1

This example relates to the recovery of uranium present in a 5 M phosphoric acid solution containing $7.10^{-4}$ mole per liter of uranium (VI).

In this example a mixture of di-2-ethylhexyldithiophosphoric acid (DEHDTP) and di-n-hexyl-octyloxymethylphosphine oxide (POX 11) diluted in dodecane is used as the organic extraction solvent, with a total DEHDTP and POX 11 concentration equal to 0.5 M per liter.

Extraction is carried out by bringing into contact in a mixer one volume of the phosphoric acid solution and one volume of the organic solvent for about 30 minutes, whilst mechanically stirring the two phase present. The two phases are then separated by centrifuging and are then sampled and analysed in order to determine the uranium concentration of each of these phases.

It is pointed out that the uranium concentration is measured by a radiometric method, which implies that a radioactive tracer constituted by $U_{233}$, which is an alpha emitter is added to the initial phosphoric solution.

After measuring the uranium concentrations of each of the phases the distribution or partition coefficient D is determined, this being equal to the ratio of the uranium concentration of the organic phase to the uranium concentration of the aqueous phase.

These operations are repeated by varying the DEHDTP and POX 11 concentrations of the mixture, the total DEHDTP and POX 11 concentrations always being equal to 0.5 M/l.

Figure 1:
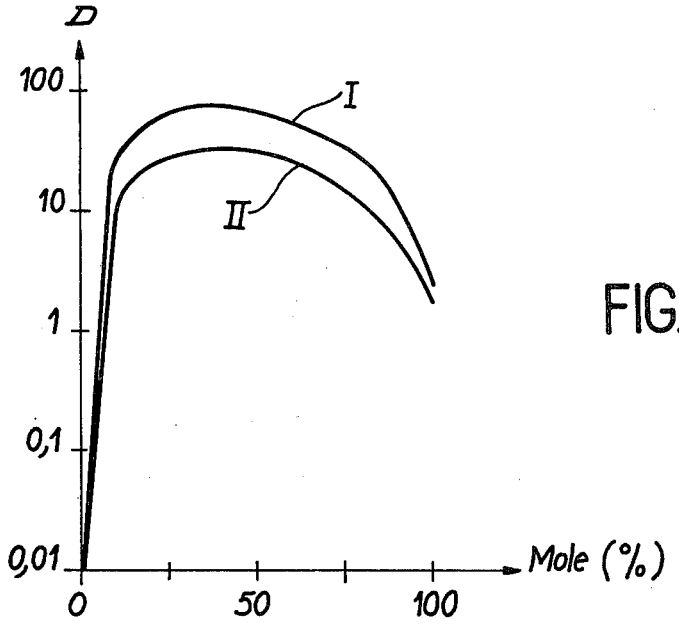
FIG. 1 a diagram showing the variations in the partition coefficient D of uranium (VI) as a function of the composition of the organic solvent, i.e. the percentage of POX 11 or TOPO molecules in the system of extractants.

The results obtained are shown in curve 1 of FIG. 1, which illustrates the variation of the partition coefficient D as a function of the composition of the organic solvent, i.e. the percentage of the POX 11 molecule in the system of extractants.

From FIG. 1 it is possible to see that the partition coefficient D varies as a function of the composition of the organic solvent and that the partition coefficient has a maximum when using an equimolar mixture of DEHDTP and POX 11. However, it should be noted that this partition coefficient has satisfactory values when the molar ratio of POX 11 to DEHDTP is between 1/9 and 3/1.

EXAMPLE 2

In this example uranium is recovered from the same phosphoric acid solution as in example 1, using as the organic extraction solvent a mixture of di-2-ethylhexyldithiophosphoric acid (DEHDTP) and trioctyl-phosphine (TOPO) diluted in dodecane with a total concentration of extractants of 0.5 M/l, extraction being performed under the same conditions as in example 1.

The results obtained when the DEHDTP and TOPO proportions in the organic solvent are varied are shown in curve II of FIG. 1.

It should also be noted that in this case the partition coefficient has a maximum when using an equimolar mixture of DEHDTP and TOPO. In the same way the results are very satisfactory when the molar ratio of TOPO and DEHDTP is between 1/9 and 3/1.

The results obtained in these two examples show that during the extraction of uranium in a phosphoric medium a complex having one molecule of TOPO or POX 11 and one molecule of DEHDTP is definitely performed when working according to the process of the invention.

EXAMPLE 3

In this example the uranium is recovered from a 5 M phosphoric acid solution containing 0.17 g/liter of uranium and 3.4 g/liter of iron, using as the organic extraction solvent a mixture of 0.25 M/liter of TOPO and 0.25 M/liter of DEHDTP diluted in dodecane. Extraction is performed under the same conditions as in example 1, but by varying the contact time between the aqueous phase and the organic phase in order to determine the extraction kinetics of uranium (VI) and iron (III).

The partition coefficient D for the uranium and the partition coefficient D for the iron are then determined by measuring the uranium and iron concentrations of the aqueous phase and the organic phase by radiometric methods and whereby the radioactive traces added to the initial solution are uranium 233, which is an alpha emitter and iron 58, which is a gamma emitter.

Figure 2:
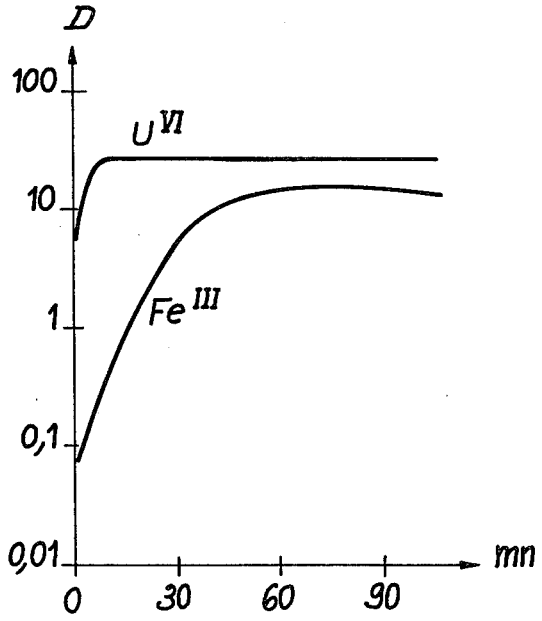
FIG. 2 a diagram showing the variations in the partition coefficient D of uranium (VI) and iron (III), as a function of the extraction period, when using a mixture of TOPO and DEHDTP as the solvent.

The results obtained are shown in FIG. 2, which respectively illustrates the variations of D for iron and uranium as a function of the extraction time (enmn).

In FIG. 2 it is possible to see that equilibrium is reached after 5 minutes with regard to uranium. However, for iron it is necessary to wait virtually an hour to observe equilibrium.

Therefore the use of a mixture of TOPO and DEHDTP makes it possible to also ensure a satisfactory separation between uranium and iron, provided that the contact time between the aqueous phase and the organic phase is limited to below 5 minutes, which can for example be realised by using a centrifugal extractor for the extraction.

When replacing DEHDTP by bis-(2,6-dimethyl-4-heptyl)-dithiophosphoric acid in this example identical values are obtained for the partition coefficient D of uranium (VI) and much lower values for the partition coefficient D of iron, the latter only reaching a value of 0.2 on equilibrium.

Thus, the use of a mixture of TOPO and bis-(2,6-dimethyl-4-heptyl)-dithiophosphoric acid makes it possible to obtain a good iron/uranium separation.

EXAMPLE 4

In this example the uranium is covered from a 5 M phosphoric acid solution, which also contains 0.17 g/liter of uranium and 3.4 g/liter of iron, using a mixture of 0.25 M/liter of POX 11 and 0.25 M/liter of DEHDTP diluted in dodecane, the extraction being performed under the same conditions as in example 3, i.e. by varying the contacting time between the aqueous phase and the organic phase.

Figure 3:
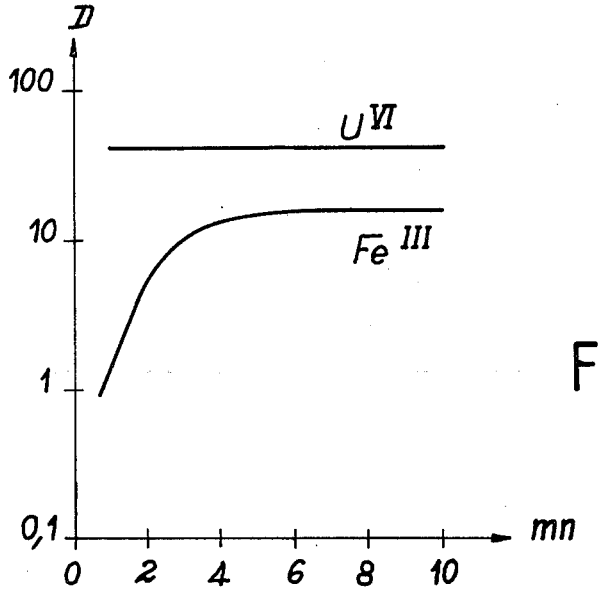
FIG. 3 a diagram showing the variations in the partition coefficient D of uranium (VI) and iron (III), as a function of the extraction period, when a mixture of POX 11 and DEHDTP is used as the solvent.

The results obtained are given in FIG. 3, which illustrates the variations of D for uranium and iron as a function of the extraction period.

In FIG. 3 it is also possible to see that uranium is extracted faster than iron. However, it should be noted that in the case where the extractant system is constituted by a mixture of DEHDTP and POX 11, equilibrium is reached much more rapidly for iron.

EXAMPLE 5

In this example uranium is recovered from a phosphoric acid solution containing $7.10^{-4}$ M/liter of uranium (VI), whilst using as the organic solvent a mixture of 0.25 M/l of TOPO and 0.25 M/l of DEHDTP diluted in dodecane, the extraction being performed under the same conditions as in Example 2. The D of the uranium is then determined for various phosphoric acid concentrations in the initial solution.

Figure 4:
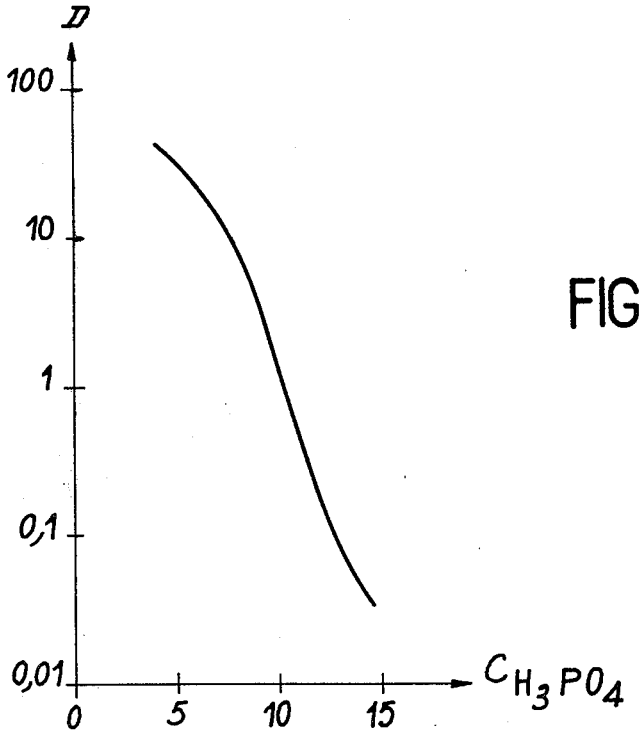
FIG. 4 a diagram showing the variations in the partition coefficient D of uranium (VI) as a function of the phosphoric acid concentration of the aqueous solution.

The results obtained are given in FIG. 4, which illustrates the variations in D of uranium, as a function of the phosphoric acid concentration in the aqueous solution. In FIG. 4 it can be seen that D decreases very rapidly when the $H_3PO_4$ concentration exceeds 8 M and is not very high when the $PO_4H_3$ concentration exceeds 10 M.

Thus, these results show that it is possible to obtain satisfactory extraction levels when the starting solution has a phosphoric acid concentration below 10 M and that it is possible to reextract the uranium from the uranium-charged organic solvent by bringing it into contact with a phosphoric acid solution having a concentration above 10 M, for example by means of a 12 M phosphoric acid solution, which corresponds to a D of 0.1, or by means of a 14 M solution, which corresponds to a D of 0.03.

However, it is also possible to reextract the uranium from the organic solvent by using phosphoric acid solutions having a phosphoric acid concentration below 10 M, provided that a reducing agent constituted for example by hydrazine and ferrous ions is added thereto, which makes it possible to reduce the uranium (VI) into uranium (IV) and to thus assist its reextraction in the phosphoric acid solution.

EXAMPLE 6

This example relates to the recovery of uranium from a 5 M phosphoric acid solution containing 0.17 g/l of uranium (VI) and 3.4 g/l of iron, using as the organic solvent a mixture of TOPO and DEHDTP diluted in dodecane.

In this example several extractions are carried out by using as the organic solvent a mixture having a DEHDTP concentration of 0.01 M/l and variable TOPO concentrations.

Extraction is carried out in a centrifugal extractor with a contact time between two phases of the order of 4 seconds. After extraction the phases are separated and they are then analysed in order to determine the partition coefficients D of the uranium and the iron, as in example 3.

Figure 5:
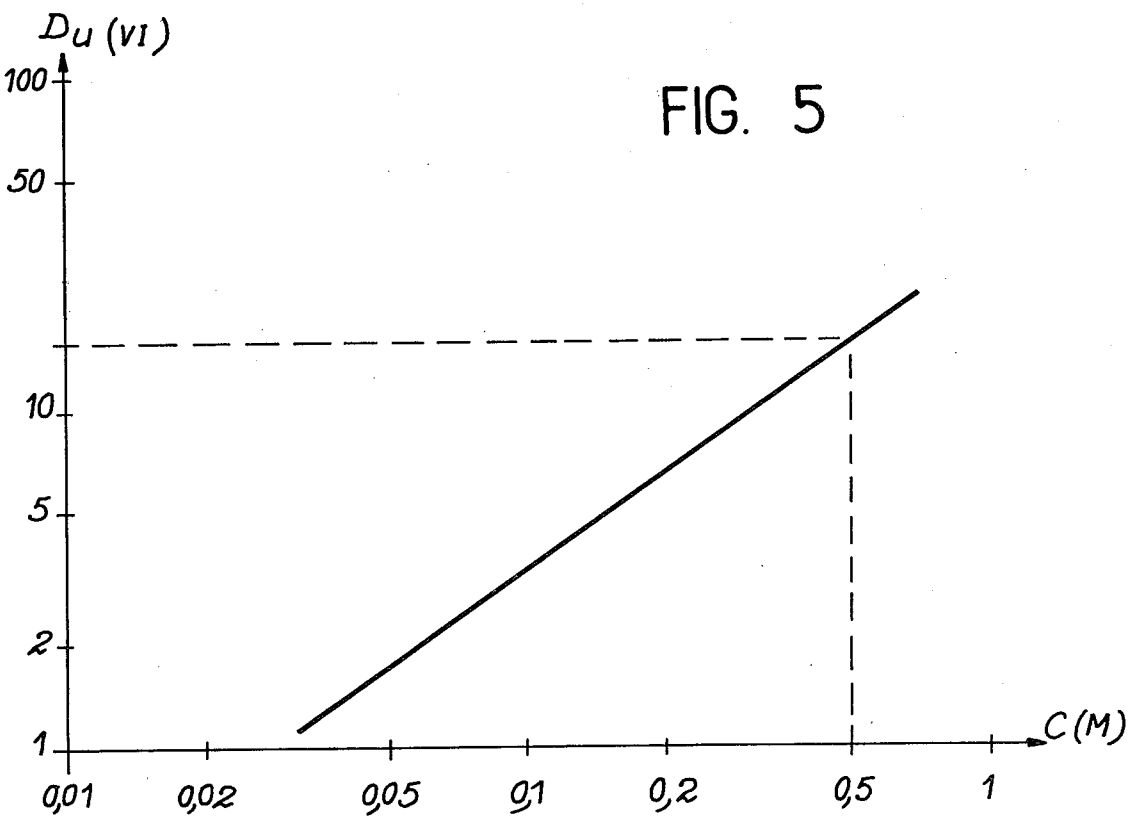
FIG. 5 a diagram showing the variations in the partition coefficient D of uranium (VI) as a function of the composition of the solvent, i.e. its concentration C (in M) of TOPO.

The results obtained with respect to the uranium are given in FIG. 5, which illustrates the variations in the partition coefficient D of uranium (VI) as a function of the TOPO C concentrations (in moles) of the organic solvent. FIG. 5 shows that good results are obtained even with a low DEHDTP concentration (0.01 M).

Moreover, it can be seen that the partition coefficient increases with the TOPO concentration in the organic solvent. Thus, in the case of a system of extractants constituted by an acid organophosphorus compound having at least one sulphur atom and by a neutral phosphine oxide extraction can be carried out under satisfactory conditions, i.e. relatively high uranium partition coefficients can be obtained, even when the mixture has a composition which is far removed from an equimolar mixture.

However, when using a system of extractants constituted by a dialkyl phosphoric acid and a neutral phosphine oxide it is not possible to obtain satisfactory partition coefficients when the composition of the mixture is far removed from the composition making it possible to obtain the best partition coefficient, i.e. the composition in which the molar ratio between the alkyl phosphoric acid and the neutral phosphine oxide is 4/1.

Thus, in the case of these extraction systems there are association reactions between the extractants, which take place concurrently during the extraction.

This is not the case with a mixture of dialkyldithiophosphoric acid and a neutral phosphine oxide, when the law governing the extraction equilibrium corresponds to the following diagram:

$$[UO_2^{2+}]_{aq}+[H_2PO_4^-]_{aq}+[DEHDTP]_{org}+[R_3PO]_{org} \rightleftharpoons [UO_2H_2PO_4(DEHDTP)R_3PO]_{org}+[H^+]_{aq}$$

With regard to iron extraction it should be noted that through carrying out the extraction in this example in a centrifugal extractor a satisfactory iron/uranium separation is possible. Thus, with a contact time of about 4 seconds, the apparent partition coefficients of the iron and uranium (VI) correspond respectively to 0.05 and 13.

Under these conditions uranium reextraction can be subsequently carried out by contacting the uranium-containing organic solvent and a 1 M ammonium carbonate solution, because the low iron quantities extracted in the organic solvent will then remain in the organic phase.

EXAMPLE 7

This example relates to the extraction of uranium from a 6 M phosphoric acid solution containing $7.10^{-4}$ M/l of uranium (VI). In this example the solvent used is a mixture of 0.25 M/l of DEHDTP and 0.25 M/l of TOPO diluted in dodecane or a mixture of 0.4 M/l of diethylhexyl phosphoric acid and 0.1 M/l of TOPO diluted in dodecane.

Uranium extraction takes place with each solvent system under the same conditions as in example 1 and at the end of the operation the distribution or partition coefficients D of the uranium are determined.

The results obtained show that the uranium (VI) partition coefficient D is higher with the solvent according to the invention. Thus, this partition coefficient D is equal to 20 for the mixture according to the invention and only 2 for the mixture of diethylhexyl phosphoric acid and TOPO.

It is pointed out that in this example a total extractant concentration of 0.5 M is used in both cases, but with in each case different proportions between the two extractants, due to the fact that in the case of mixtures according to the invention a distribution coefficient maximum is observed for the proportion 1/1, whereas this is for the proportion 4/1 in the case of mixtures of dialkyl phosphoric acid and neutral phosphine oxide.

What is claimed is:

1. A process for the recovery of the uranium present in a phosphoric acid solution by bringing the said solution into contact with an organic solvent suitable for extracting the uranium, wherein the said organic solvent comprises a system of extractants constituted by a dialkyl-dithiophosphoric acid and by a neutral phosphine oxide of formula:

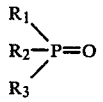

in which $R_1$, $R_2$ and $R_3$ are identical or different alkyl, alkoxyalkyl or aryl radicals.

2. A process according to claim 1, wherein the dialkyl-dithiophosphoric acid is di-2-ethylhexyl-dithiophosphoric acid.

3. A process according to claim 1, wherein the dialkyl-dithiophosphoric acid is bis-(2,6-dimethyl-4-heptyl)-dithiophosphoric acid.

4. A process according to claim 1, wherein the neutral phosphine oxide is trioctyl-phosphine oxide.

5. A process according to claim 1, wherein the neutral phosphine oxide is di-n-hexyl-octyloxymethyl-phosphine oxide, having the following formula:

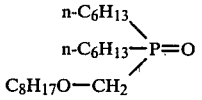

6. A process according to claim 1, wherein the concentrations of said extractants are such that the molar ratio of the neutral phosphine oxide to the acid organophosphorus compound having at least one sulphur atom must be between 1.9 and 3.1.

7. A process according to claim 6, wherein the molar ratio of the neutral phosphine oxide to the acid organophosphorus compound having at least one sulphur atom is equal to 1.

8. A process according to claim 2 for the recovery of the uranium present in a phosphoric acid solution which also contains iron, wherein the phosphoric acid solution is brought into contact with the organic solvent for a time less than 5 minutes in order to separate the iron from the uranium.

9. A process according to claim 1, wherein the uranium present in the organic solvent is then reextracted by bringing the organic solvent into contact with an aqueous phosphoric acid solution having a phosphoric acid concentration in excess of 10 M.

10. A process according to claim 1, wherein the uranium present in the organic solvent is then reextracted by bringing the organic solvent into contact with an aqueous phosphoric acid solution containing a reducing agent constituted by hydrazine, ferrous ions or their mixtures.

* * * * *